US006787230B2

(12) United States Patent
Kim

(10) Patent No.: US 6,787,230 B2
(45) Date of Patent: Sep. 7, 2004

(54) ULTRAFINE INORGANIC FIBER, AND A PROCESS OF PREPARING FOR THE SAME

(76) Inventor: Hag-Yong Kim, 410-6, Pyunghwa-dong 2ga, Wansan-gu, Jeonju-si, 560-865, Chonrabuk-do (KR)

( * ) Notice: Subject to any disclaimer, the term of this patent is extended or adjusted under 35 U.S.C. 154(b) by 0 days.

(21) Appl. No.: 10/250,368

(22) PCT Filed: Dec. 9, 2002

(86) PCT No.: PCT/KR02/02314

§ 371 (c)(1),
(2), (4) Date: Jul. 1, 2003

(87) PCT Pub. No.: WO03/005033

PCT Pub. Date: Jun. 19, 2003

(65) Prior Publication Data

US 2004/0067358 A1 Apr. 8, 2004

(30) Foreign Application Priority Data

| | | |
|---|---|---|
| Dec. 13, 2001 | (KR) | 10-2001-0078778 |
| Feb. 15, 2002 | (KR) | 10-2002-0008049 |
| Apr. 3, 2002 | (KR) | 10-2002-0018277 |
| Jun. 12, 2002 | (KR) | 10-2002-0032767 |

(51) Int. Cl.[7] ..... D02G 3/00

(52) U.S. Cl. ..... 428/401; 428/364; 57/402; 264/211.12; 264/211.11; 264/205; 264/290.5

(58) Field of Search ..... 428/364, 401; 264/211.11, 211.12, 205, 290.5; 57/402

(56) References Cited

U.S. PATENT DOCUMENTS

| | | | | |
|---|---|---|---|---|
| 6,068,800 A | * | 5/2000 | Singh et al. | 264/8 |
| 6,106,913 A | | 8/2000 | Scardino et al. | |
| 6,203,768 B1 | * | 3/2001 | McCormick et al. | 423/1 |
| 6,207,273 B1 | * | 3/2001 | Kurihara et al. | 428/364 |

FOREIGN PATENT DOCUMENTS

KR 2001-0097747 A 11/2001

* cited by examiner

*Primary Examiner*—Merrick Dixon
(74) *Attorney, Agent, or Firm*—Birch, Stewart, Kolasch, & Birch, LLP

(57) ABSTRACT

The present invention relates to ultra-fine inorganic fibers and a method of producing the same. The method of producing ultra-fine inorganic fibers comprises the steps of: mixing sol or gel containing an inorganic material and thermoplastic resin solution and reacting them to produce a mixture solution thereof; electronically spinning the mixture solution under a high voltage to produce a composite fiber with the inorganic material embedded in the thermoplastic resin; and carbonating the thermoplastic resin in the composite fiber or dissolving the same in a solvent. Thereby an ultra-fine inorganic fiber is prepared which has a length 100 to 10,000 times larger than its diameter and a diameter of 10 to 1,000 nm. The ultra-fine inorganic fiber of the present invention has a very large specific surface area with respect to its volume. Thus it is very useful as catalyst supporting materials, reinforcing materials, coating materials or the like in every field of industry.

8 Claims, 7 Drawing Sheets

ULTRAFINE INORGANIC FIBER, AND A PROCESS OF PREPARING FOR THE SAME

This application is the national phase under 35 U.S.C. §371 of PCT International Application No. PCT/KR02/02314 which s an International filing date of Dec. 9, 2002, which designated the United States of America.

TECHNICAL FIELD

The present invention relates to a ultra-fine inorganic fibers and a method of producing the same which are applicable to all industrial fields because they have a very large specific surface area with respect to its volume.

Inorganic particles and inorganic fibers can be utilized in every fields of industry, including glass reinforcing agents, contact lens reinforcing materials, various coating agents, part materials in the bio sensor sector, bullet-proof vests, bullet-proof helmets, part materials in the space-air sector, part materials in the electronic sector, part materials such as artificial bones, artificial vessels, etc. in the medical sector, heat resistant materials and the like.

BACKGROUND ART

U.S. Pat. No. 5,917,279 discloses a method of inorganic particles having a diameter of 1 to 100 nm, dispersed in a polymer binder, for the production of intermediate layers in electroluminescent arrangements. U.S. Pat. No. 6,203,768 discloses a process for producing nano-phase inorganic particles by obtaining a nano-phase metal substance embedded in a by-product phase from a mixture of a metal compound and an active material and then removing the by-product phase.

Additionally, U.S. Pat. No. 6,068,800 discloses a process for producing nano-scale particles comprising the steps of: placing a substrate on a rotatable specimen holder that is inside a reactive chamber; filling said reactive chamber with a liquid precursor solution; rotating said specimen holder; irradiating said rotating substrate and said liquid precursor solution with a laser beam; and separating said nano-scale particles from the irradiated liquid precursor solution.

The conventionally produced inorganic particles have a relatively smaller length with respect to their diameter as compared to ultra-fine inorganic fibers. That is, because they have a relatively smaller specific surface area than their volume, their effects are not good relatively when they are used as a reinforcing material.

In a paper by R. Venkatesh (Journal of the European Ceramic Society, vol. 20, 2543–2549, 2000), there is reported a method of producing alumina fibers having a diameter of more than 10 $\mu$m comprising the steps of: adding SiO2 sol and polylactic acid or polyvinyl alcohol to aluminum oxychloride sol containing 30.5 weight % alumina and mixing them to thereby produce a mixture solution; spinning the mixture solution with sol to produce a gel spun fiber; and calcining the fiber at a temperature of more than 500° C.

In this way, since only inorganic fibers having a diameter of more than 10 $\mu$m have been producible by the known methods, there was a limit in increasing the specific surface area of the inorganic fibers with respect to their volume.

Accordingly, it is an object of the present invention to provide a method of producing ultra-fine inorganic fibers having a ratio of length to diameter in excess of 100 and a diameter of 10 to 1,000 nm using an electronic spinning method. In addition, it is another object of the present invention to provide ultra-fine inorganic fibers which are useful as reinforcing materials and coating materials in various fields of industry because they have a very large specific surface area with respect to their volume.

DISCLOSURE OF INVENTION

To achieve the above objects, there is provided a method of producing ultra-fine inorganic fibers according to the present invention, comprising the steps of: mixing sol or gel containing an inorganic material and thermoplastic resin solution and reacting them to produce a mixture solution thereof; electronically spinning the mixture solution under a high voltage to produce a composite fiber with the inorganic material embedded in the thermoplastic resin; and carbonating the thermoplastic resin in the composite fiber or dissolving the same in a solvent.

Additionally, the ultra-fine inorganic fibers of the present invention have a length 100 to 10,000 times larger with respect to their diameter and a diameter of 10 to 1,000 nm.

The present invention will now be described in detail with reference to the accompanying drawings.

Firstly, sol or gel containing an inorganic material is mixed and reacted with a thermoplastic resin solution to thereby produce a mixture solution thereof.

More specifically, a thermoplastic resin is dissolved in a distilled water, tetrahydrofuran, N,N-dimethylformamide or a mixed solvent thereof to thereby produce a thermoplastic resin solution. Then, the sol or gel containing the inorganic material is input and agitated to thereby produce a mixture solution thereof.

Here, the inorganic material is one of silica, ceramic, titanium, phosphor-tungsten, boron, alumina or the like. At this time, the sol or gel containing the inorganic material includes titanium isopropoxide sol or gel, aluminum alkoxyde sol or gel of the aluminum group, heteropolyacid sol or gel, silica sol or gel, ceramic sol or gel and the like.

The thermoplastic resin is one of polyvinyl acetate, polyvinyl alcohol, polylactic acid, polyamide, polyester, polypropylene and the like.

For example, in case of producing ultra-fine silica fibers, firstly, it is preferable that the molar ratio of silica gel:phosphoric acid:distilled water is adjusted to 1 to 5:0.1 to 1:10 to 80 to be agitated and a polyvinyl alcohol solution is added thereto to thereby produce a mixture solution thereof.

Next, the mixture solution is electronically spun under a high voltage to thus produce a composite fiber having an inorganic material embedded in thermoplastic resin. At this time, the electronic spinning is performed using a common electronic spinning apparatus.

Specifically, as shown in FIG. 1, the common electronic spinning apparatus comprises a main tank 1 storing a spinning dope, a metering pump 2 for constantly feeding the spinning dope, a plurality of nozzles discharging the spinning dope, a collector 4 being located at a lower end of the nozzles and collecting spun fibers, a voltage generator 6 generating a voltage and conduction apparatuses 5 transferring the generated voltage to the nozzles and the collector. The spinning dope in the main tank 1 is continuously and constantly transferred to the plurality of nozzles 3 that is given a high voltage through the metering pump 2.

Continually, the spinning dope transferred to the nozzles 3 is spun and collected on the collector 4 with a high voltage through the nozzles to thereby form a monofilament web. Preferably, the voltage required for the electronic spinning is more than 5 kV and the composite fiber having an inorganic material/thermoplastic resin produced by the electronic spinning has a diameter of less than 1,000 nm.

Next, the thermoplastic resin in the composite fiber is completely removed by carrying out a high temperature heat treatment or solvent treatment on the produced composite fiber, thereby producing an ultra-fine inorganic fiber of the present invention. The thermoplastic resin in the composite fiber is removed by being carbonated by the high temperature heat treatment or being dissolved by the solvent treatment. In this way, as the thermoplastic resin enclosing the inorganic material is completely removed, the diameter of the inorganic fiber becomes finer.

The thusly produced ultra-fine inorganic fiber of the present invention has a length 100 to 1,000 times larger than its diameter and has a diameter of 10 to 1,000 nm.

Therefore, since the ultra-fine inorganic fiber of the present invention has a very fine diameter and a very large specific surface area with respect to its volume, it is more useful for materials of various fields of industry.

It is also possible to produce inorganic particles by crushing the ultra-fine inorganic fiber of the present invention.

BRIEF DESCRIPTION OF THE DRAWINGS

The above objects, features and advantages of the present invention will become more apparent from the following detailed description when taken in conjunction with the accompanying drawings, in which.

Figure 1:
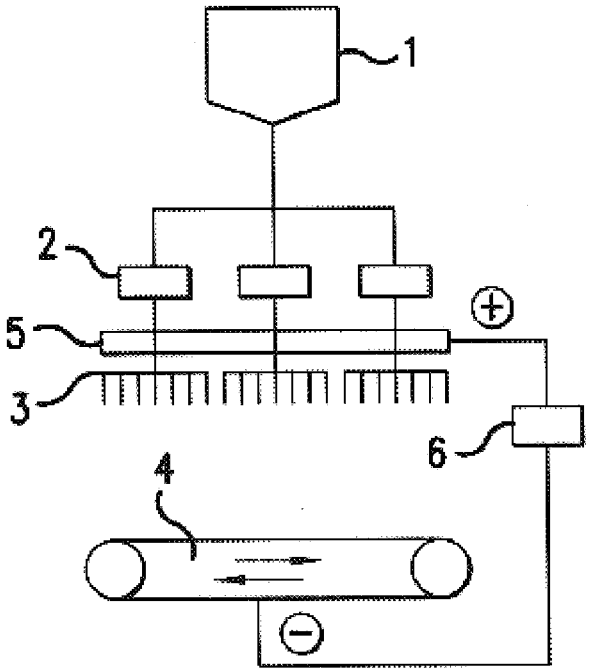
FIG. 1 is a schematic flow chart of a process of producing fibers by an electro spinning method.
Figure 2:
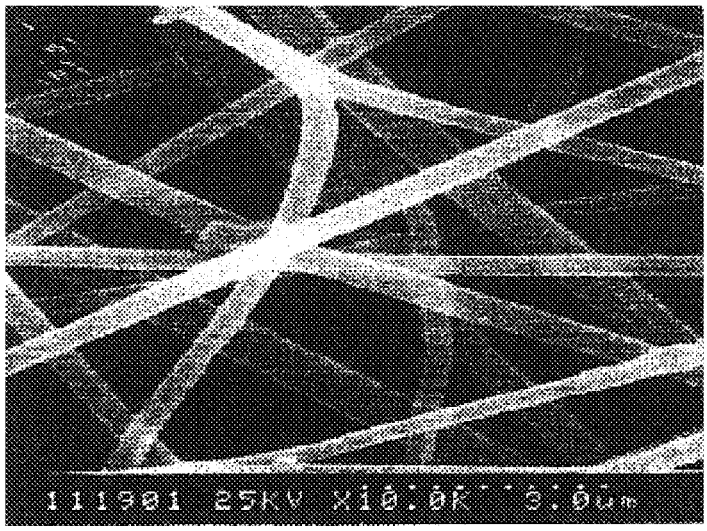
FIG. 2 is an electron micrograph of a composite fiber according to the present invention having silica embedded in polyvinyl alcohol before carbonating treatment.

Description of reference numerals of main parts of the drawings

| | | |
|---|---|---|
| 1: main tank for spinning dope | 2: metering pump | 3: nozzle |
| 4: collector | 5: voltage transfer rod | 6: voltage gererator |

BEST MODES FOR CARRYING OUT THE INVENTION

The present invention is now understood more concretely by the following examples. However, the present invention is not limited to such examples.

EXAMPLE 1

Figure 3:
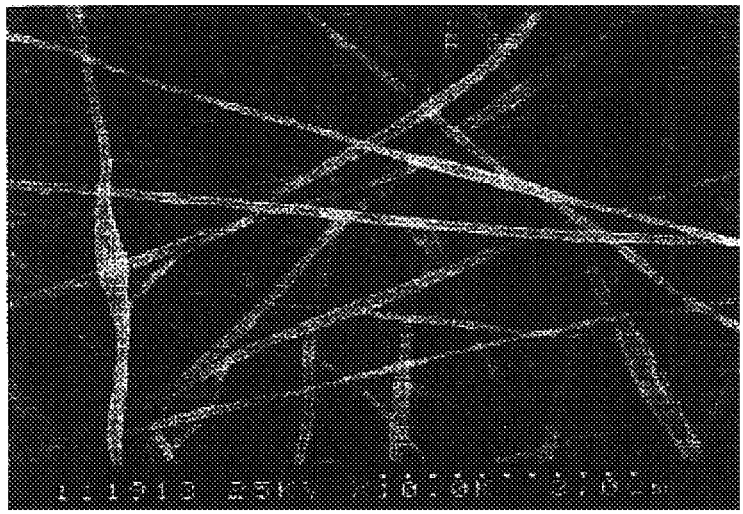
FIG. 3 is an electron micrograph of an ultra-fine inorganic fiber obtained by carbonating the composite fiber of FIG. 2 at 700° C.
Figure 4:
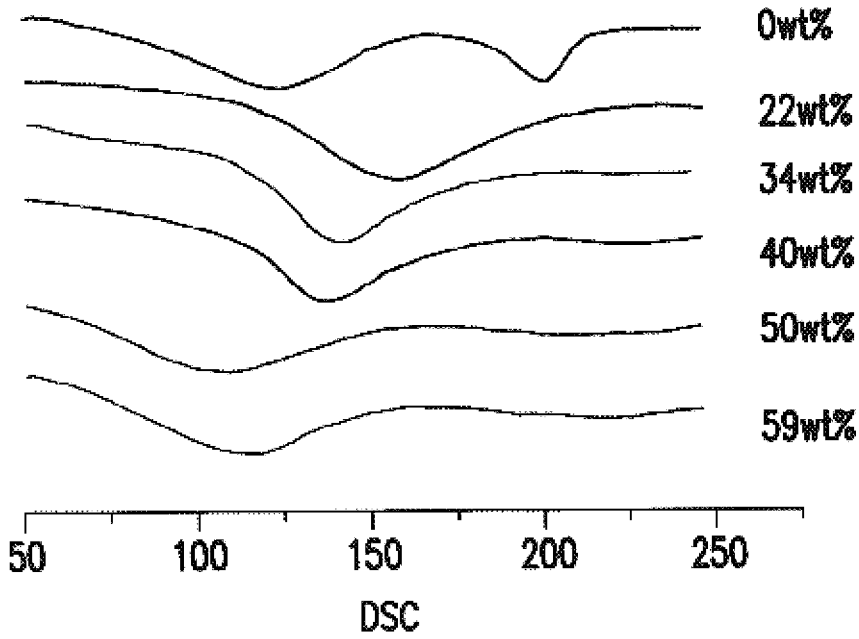
FIG. 4 is a differential scanning calorimetry (DSC) graph of a silica/polyvinyl alcohol composite fiber depending on the content of silica.
Figure 5:
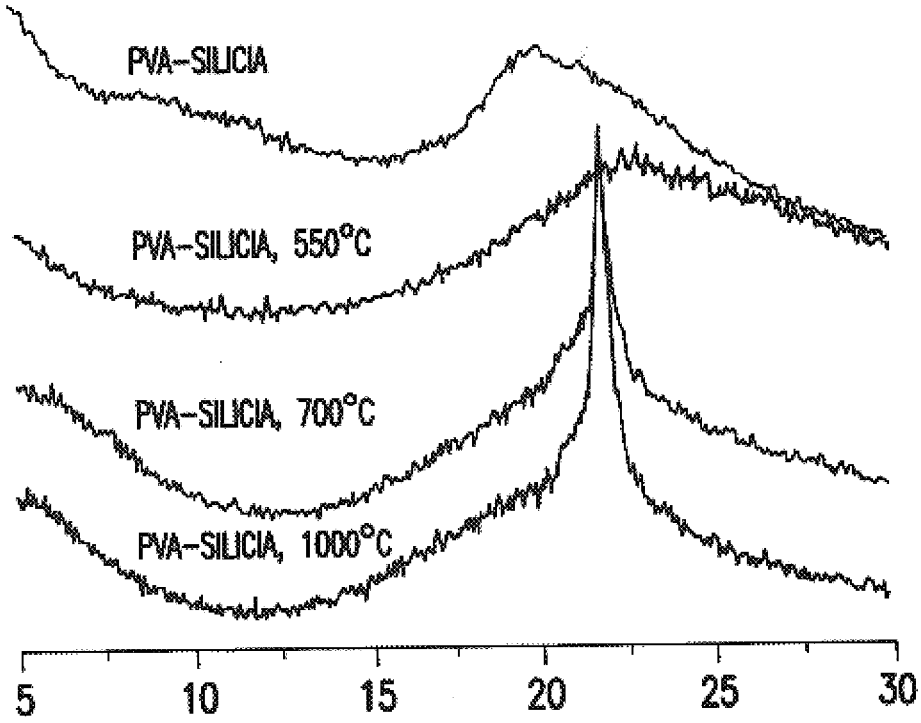
FIG. 5 is a wide angle X-ray diffraction graph of the silica/polyvinyl alcohol composite fiber.

Silica gel was agitated at a room temperature and was added with phosphoric acid and distilled water by dropping such that the molar ratio of silica gel:phosphoric acid:distilled water can be 1:0.2:11. Then, the mixture was agitated for 6 hours to prepare a silica gel solution. Next, polyvinyl alcohol was dissolved in distilled water to thereby prepare a 10% concentration polyvinyl alcohol solution. This polyvinyl alcohol solution was gradually transferred to the silica gel solution, and mixed and reacted therewith for 12 hours at 60° C. to prepare a silica/polyvinyl alcohol mixture solution. Continuously, the silica/polyvinyl alcohol mixture solution was electronically spun under a voltage of 20 kV to prepare a silica/polyvinyl alcohol composite fiber having a diameter of 500 nm. Then, the prepared silica/polyvinyl alcohol composite fiber was carbonated at 700° C. and the polyvinyl alcohol in the composite fiber was removed to prepare an ultra-fine silica fiber. FIG. 3 illustrates an electron micrograph of the prepared ultra-fine silica fiber and the diameter thereof is 100 nm.

EXAMPLE 2

Figure 6:
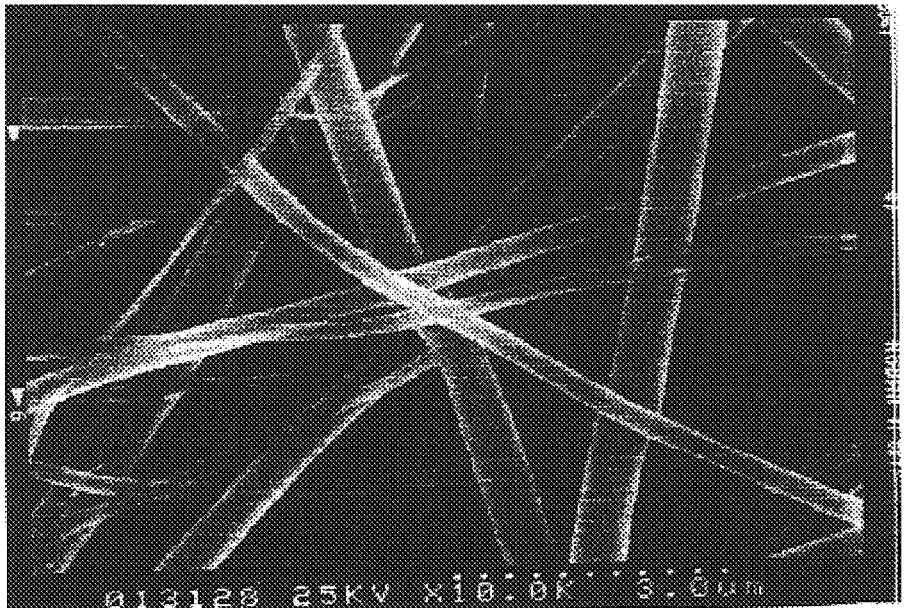
FIG. 6 is an electron micrograph of the composite fiber of the present invention having titanium consisting of 58 parts by weight of titanium isopropoxide and 42 parts by weight of polyvinyl acetate embedded in polyvinyl acetate (before carbonation treatment)
Figure 7:
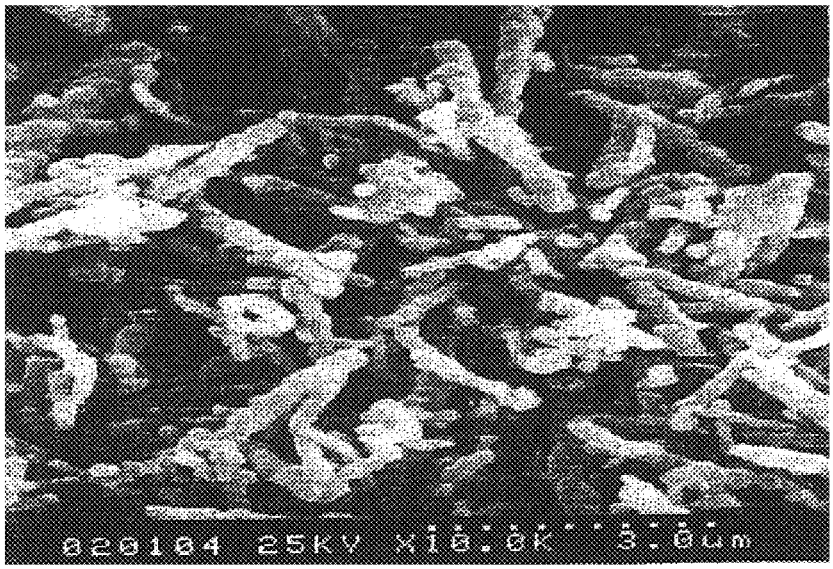
FIG. 7 is an electron micrograph of a titanium ultra-fine fiber after carbonating the composite fiber of FIG. 6 at 1,000° C.

42 parts by weight of polyvinyl acetate were dissolved in a mixed solvent (molar ratio of 4/6) of tetrahydrofuran/N, N-dimethylformamide and 58 parts by weight of titanium isopropoxide were gradually input thereto and agitated. Next, a small amount of acetic acid was added to the mixture and was mixed and reacted therewith for 12 hours at 60° C. to prepare a mixture solution of polyvinyl acetate and titanium isopropoxide. Continuously, the titanium isopropoxide/polyvinyl acetate mixture solution was electronically spun under a voltage of 30 kV to prepare a titanium isopropoxide/polyvinyl acetate composite fiber having a diameter of 560 nm. FIG. 6 illustrates an electron micrograph of the composite fiber. Next, the composite fiber was carbonated for 2 hours at 1,000° C. to prepare an ultra-fine titanium fiber. FIG. 7 illustrates an electron micrograph of the ultra-fine titanium fiber and the average diameter of the fiber was 280 nm and its length was 12 times larger than its diameter.

Figure 8:
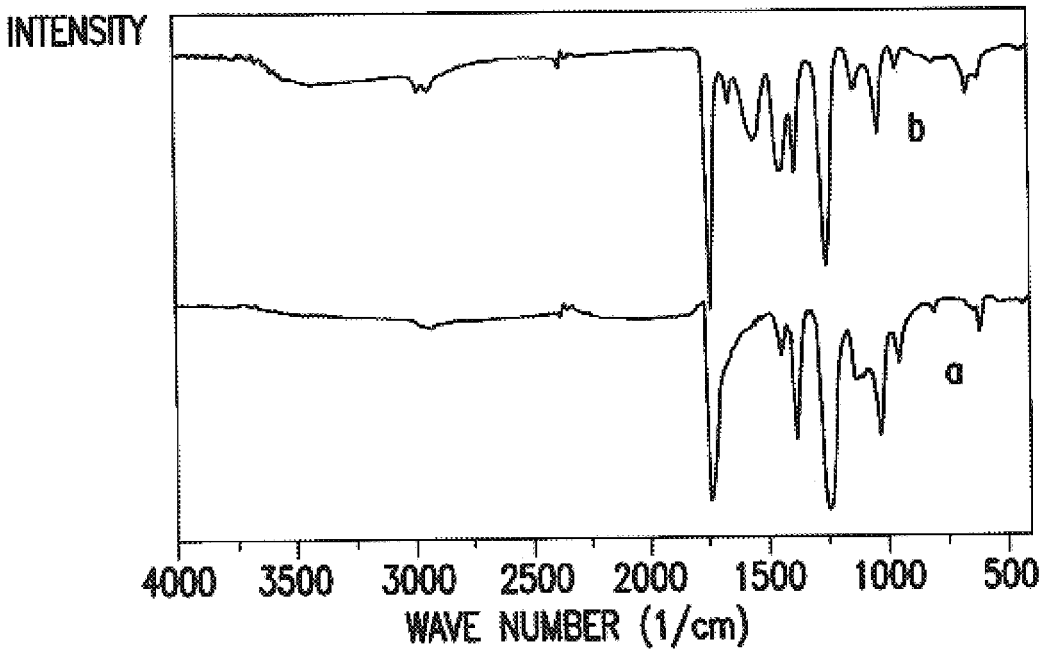
FIG. 8 is a graph showing the Fourier transform spectra of the titanium isopropoxide/polyvinyl acetate composite fiber and the polyvinyl acetate fiber of FIG. 6, wherein a is a graph of the polyvinyl acetate fiber and b is a graph of the composite fiber of FIG. 6.

Graph b of FIG. 8 illustrates a graph showing the Fourier transform spectra of the composite fiber. Graph b of FIG. 8 has two peaks at 1,500 to 1,600 $cm^{-1}$, which means the progress of hydration. For reference, Graph a of FIG. 8 illustrates a graph showing the Fourier transform spectra of the fiber only made of polyvinyl acetate.

Figure 9:
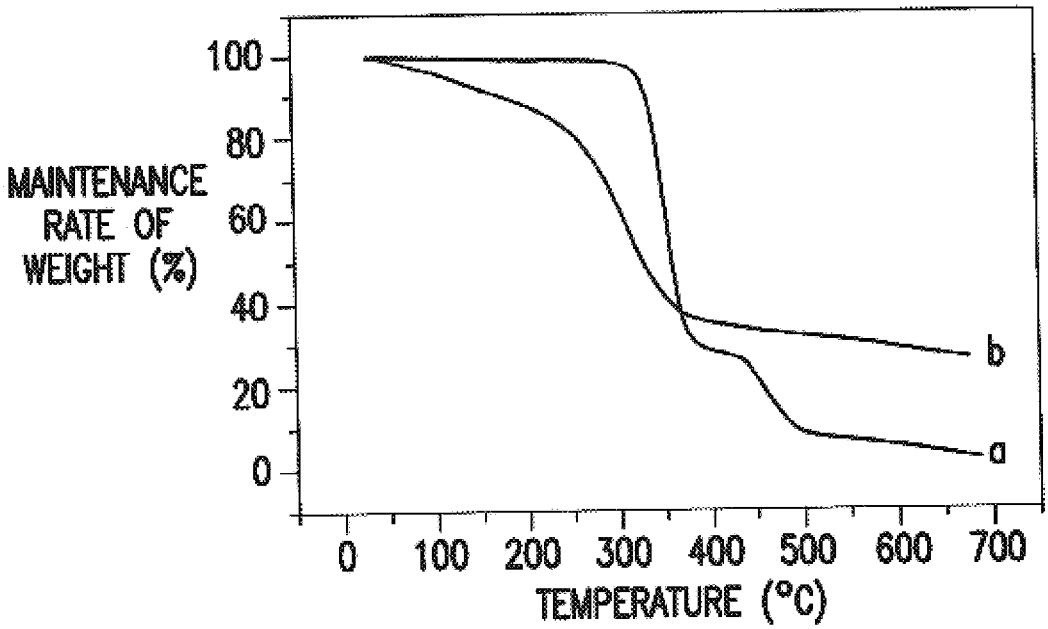
FIG. 9 is a graph showing a thermogravimetric analysis curve of the titanium isopropoxide/polyvinyl acetate composite fiber and the polyvinyl acetate fiber, wherein a is a graph of the polyvinyl acetate fiber and b is a graph of the composite fiber of FIG. 6.

Graph b of FIG. 9 illustrates a thermogravimetric curve of the composite fiber. In Graph b of FIG. 9, it can be known that the composite fiber keeps (remains) 40% of the overall weight even at 700° C. although the weight of the composite fiber is decreased at 700° C. as the carbonation of polyvinyl acetate proceeds. For reference, Graph a of FIG. 9 illustrates a graph showing a thermogravimetric curve of the fiber only made of polyvinyl acetate.

EXAMPLE 3

Figure 10:
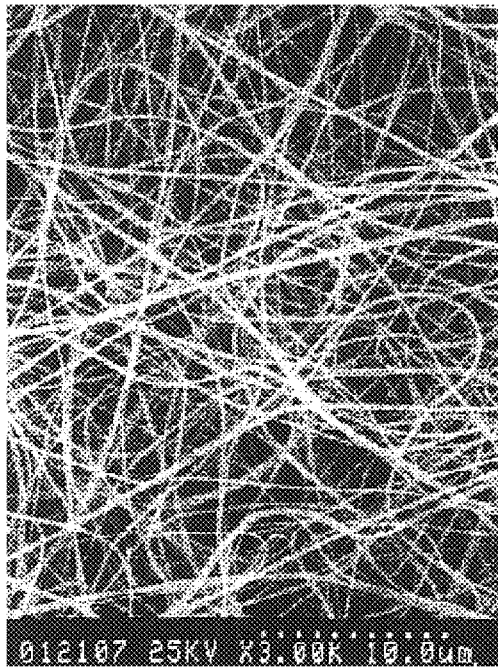
FIG. 10 is an electron micrograph of the composite fiber consisting of 66 parts by weight of heteropolyacid and 34 parts by weight of polyvinyl alcohol.

34 parts by weight of polyvinyl alcohol were dissolved in distilled water at 80° C. for one hour and then were cooled to a room temperature. The polyvinyl alcohol solution was gradually transferred to an aqueous solution containing 66 parts by weight of $P_2W_{18}$ of heteropolyacid by dropping and then was reacted therewith for 24 hours with strong agitation at a room temperature, thereby preparing a complex of heteropolyacid and polyvinyl alcohol hybrid bonded by a hydrogen bond between heteropolyacid and polyvinyl alcohol. Continuously, the heteropolyacid/polyvinyl alcohol reaction solution was electronically spun under a voltage of 18 kV to prepare a heteropolyacid/polyvinyl alcohol composite fiber having a diameter of 550 nm. FIG. 10 illustrates an electron micrograph of the composite fiber. Next, the composite fiber is carbonated for two hours at 500° C. to prepare a phosphor-tungsten ultra-fine fiber. The ultra-fine phosphor-tungsten fiber has an average fiber diameter of 250 nm and a length 15 times larger than its diameter.

EXAMPLE 4

Figure 11:
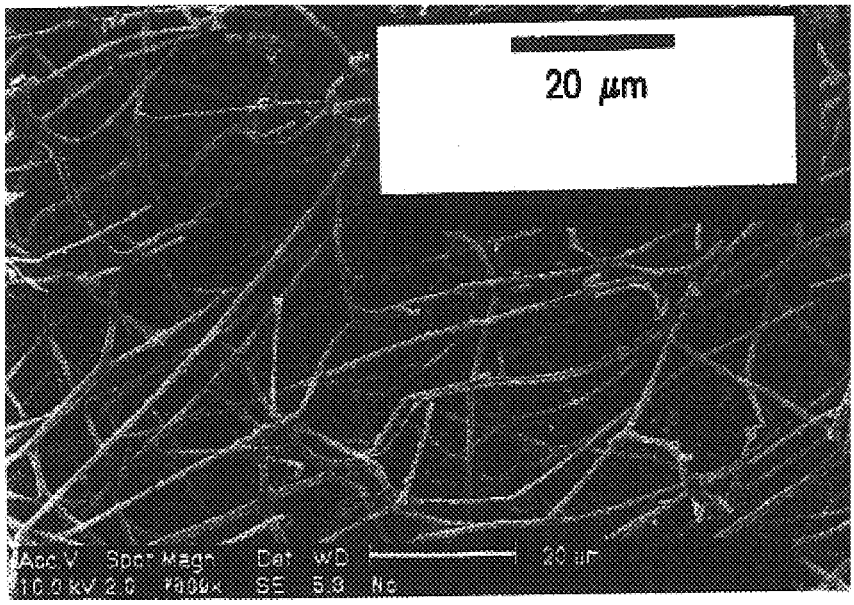
FIG. 11 is an electron micrograph of a polyvinyl alcohol/alumina-boron composite fiber.
Figure 12:
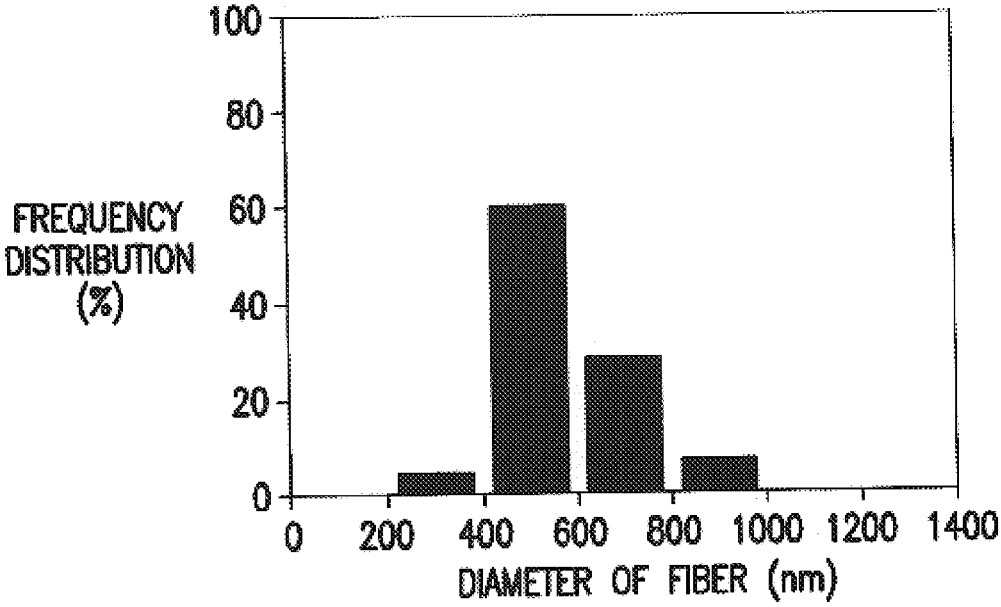
FIG. 12 is a diameter distribution chart of the polyvinyl alcohol/alumina-boron composite fiber.

10 parts by weight of polyvinyl alcohol were dissolved for one hour at 80° C. and then cooled to a room temperature. The polyvinyl alcohol solution was gradually transferred to alumina sol $[(Al_2O_3)\mathbf{9}(B_2O_3)_2]$ by dropping and then was reacted therewith for 24 hours with strong agitation at a room temperature, thereby preparing an alumina sol/polyvinyl alcohol reaction solution. Continuously, the alumina sol/polyvinyl alcohol reaction solution was electronically spun under a voltage of 20 kV to prepare a alumina-boron/polyvinyl alcohol composite fiber having a diameter of 560 nm. FIG. 11 illustrates an electron micrograph of the composite fiber. FIG. 12 illustrates a diameter distribution chart. The average diameter of the fiber was 565 nm.

EXAMPLE 5

Figure 13:
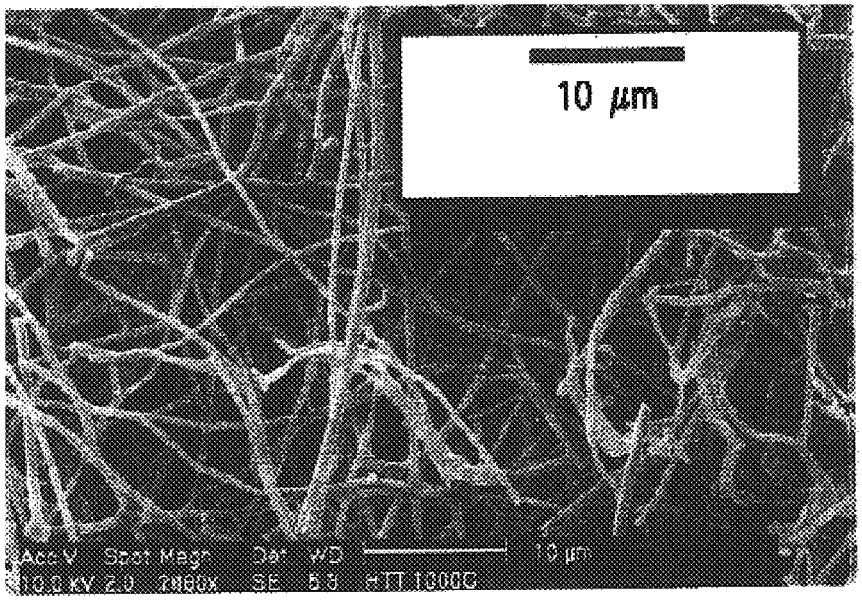
FIG. 13 is an electron micrograph of an ultra-fine alumina-boron fiber produced by removing the polyvinyl alcohol in the composite fiber by sintering the composite fiber of FIG. 11 at 1000° C. for two hours.
Figure 14:
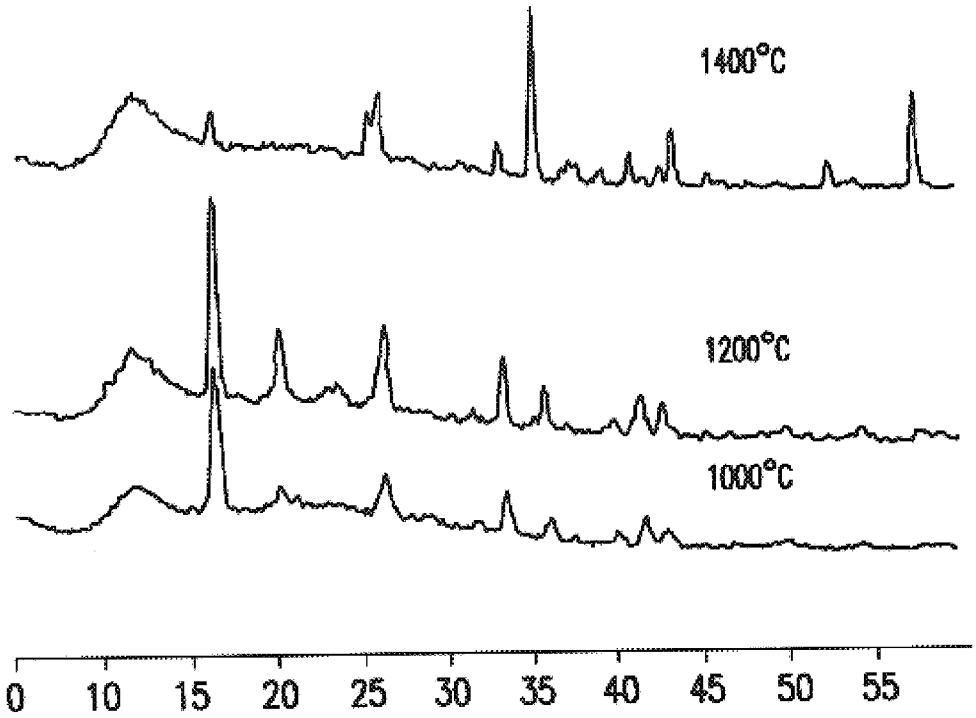
FIG. 14 is a X-ray diffraction curve of an alumina fiber depending on a heat treatment temperature.

The alumina-boron/polyvinyl alcohol composite fiber prepared in Example 4 was sintered for two hours at 1000° C. to prepare an alumina-boron fiber. FIG. 13 illustrates an electron micrograph of the prepared alumina-boron fiber. It can be known from the X-ray diffraction curve of FIG. 14 that the average diameter of the fiber was 625 nm and an aluminum component and a boron component coexist.

INDUSTRIAL APPLICABILITY

The ultra-fine inorganic fiber of the present invention has a diameter of less than 1,000 nm and has a very large specific surface area with respect to its volume. Thus it is very useful as catalyst supporting materials, reinforcing materials, coating materials or the like in every field of industry.

What is claimed is:

1. A method of producing ultra-fine inorganic fibers, comprising the steps of:

mixing sol or gel containing an inorganic material and thermoplastic resin solution and reacting them to produce a mixture solution thereof;

electronically spinning the mixture solution under a high voltage to produce a composite fiber with the inorganic material embedded in the thermoplastic resin; and carbonating the thermoplastic resin in the composite fiber or dissolving the same in a solvent.

2. The method of claim 1, wherein the diameter of the inorganic fiber is less than 10 to 1,000 nm.

3. The method of claim 1, wherein the voltage required for the electronic spinning is more than 5 kV.

4. The method of claim 1, wherein the inorganic material is one of silica, ceramic, titanium, phosphor-tungsten, boron or alumina.

5. The method of claim 1, wherein the thermoplastic resin is one of polyvinyl acetate, polyvinyl alcohol, polylactic acid, polyamide, polyester or polypropylene.

6. The method of claim 1, wherein the sol or gel containing the inorganic material is one of titanium isopropoxide sol or gel, aluminum alkoxyde sol or gel, heteropolyacid sol or gel, silica sol or gel, or ceramic sol or gel.

7. Ultra-fine inorganic fibers which have a length 100 to 10,000 times larger than its diameter and a diameter of 10 to 1,000 nm and whose inorganic material is embedded in thermoplastic resin.

8. The ultra-fine inorganic fibers of claim 7, wherein the inorganic material is one of silica, ceramic, titanium, phosphor-tungsten, boron or alumina.

* * * * *